US006044614A

United States Patent [19]

Bryant

[11] Patent Number: 6,044,614

[45] Date of Patent: Apr. 4, 2000

[54] SEQUENTIAL FORMWORK SYSTEM FOR CONCRETE BUILDINGS

[75] Inventor: Stanley Bryant, Taree, Australia

[73] Assignee: Newtec Concrete Construction Pty Limited, Australia

[21] Appl. No.: 08/952,920

[22] PCT Filed: May 8, 1996

[86] PCT No.: PCT/AU96/00279

§ 371 Date: Apr. 13, 1998

§ 102(e) Date: Apr. 13, 1998

[87] PCT Pub. No.: WO96/37674

PCT Pub. Date: Nov. 28, 1996

[51] Int. Cl.[7] ..... E04G 21/02

[52] U.S. Cl. ..... 52/745.12; 249/34; 264/31

[58] Field of Search ..... 52/741.13, 741.15, 52/745.05, 745.09, 745.1, 745.12; 249/34, 39; 264/31

[56] References Cited

U.S. PATENT DOCUMENTS

| | | | |
|---|---|---|---|
| 1,142,887 | 6/1915 | Kennan | 249/34 |
| 2,099,077 | 11/1937 | Pessagno et al. | 349/34 |
| 3,171,185 | 3/1965 | Anderson | 249/34 |
| 4,186,160 | 1/1980 | Landreth | 249/34 |
| 4,210,305 | 7/1980 | Williams . | |
| 4,424,951 | 1/1984 | Spencer . | |
| 5,397,095 | 3/1995 | Jeffrey | 249/39 |

FOREIGN PATENT DOCUMENTS

| | | |
|---|---|---|
| 7360891 | 3/1991 | Australia . |
| 1188126 | 6/1985 | Canada . |
| 911523 | 7/1946 | France . |
| 2239892 | 2/1975 | France . |
| 2265941 | 10/1975 | France . |
| 2537192 | 6/1984 | France . |
| 1438636 | 6/1976 | United Kingdom . |
| 9202701 | 2/1992 | WIPO . |

OTHER PUBLICATIONS

Patent Abstracts of Japan, M–1212, p. 134, JP 3–260234 A (Shimizu Corp) Nov. 20, 1991.

Patent Abstracts of Japan, M–975, p. 21, JP2–61238 A (Kajima Cor p) Mar. 1, 1990.

*Primary Examiner*—Michael Safavi

*Attorney, Agent, or Firm*—Mayer, Brown & Platt

[57] ABSTRACT

A method of constructing concrete structures using reusable formwork comprising the steps of positioning and securing base portion formwork comprised of at least a pair of opposing panels; positioning and securing upper portion formwork on top of the base portion formwork, each upper portion formwork comprised of at least a pair of opposing panels; pouring concrete between the panels and allowing it to set; and removing the formwork. The method further comprises the steps of providing blanking panels for windows and doors and providing insulation within the walls.

13 Claims, 18 Drawing Sheets

27
13
32
13

27
32
31
13
9B

9B

SEQUENTIAL FORMWORK SYSTEM FOR CONCRETE BUILDINGS

TECHNICAL FIELD

This invention relates to building structures formed substantially of concrete, and to methods of building construction using concrete. In particular it relates to formwork and associated supports for the construction of walls, raked roof beams and columns, etc. for buildings formed of concrete material.

DESCRIPTION OF PRIOR ART

There are disadvantages in the commonly used building practices used by builders, particularly for the construction of small buildings, where a large number of sub-contract trades people have to be managed.

The "concrete-tilt-up" system introduced over recent years leaves much to be desired. The preformed slabs used in such system can only be handled by the use of special lifting equipment, and, if sealing between the joints is not correctly performed, moisture and insects may ingress the building. Structural stability of the upright wall is a disadvantage in this system.

Timber places high demands on forests, which are being increasingly valued for their environmental and quality-of-life benefits, and also, is subject to termite attack.

Concrete has various inherent advantages, including strength, durability and supply and price stability, and is generally used where physically possible. Reinforced concrete is used in large scale constructions to an extent where it is almost universal, demonstrating its effectiveness as a building material.

Prior art construction methods of forming up and pouring concrete walls in-situ are cumbersome. The provision of formwork is labour intensive, having to be erected by tradesmen, and, a large proportion of such materials are non-reusable after the concrete is poured. The formwork on both sides of any wall is tied together using bolts passing through the wall cavity, which not only results in a wall having many holes passing through it requiring filling, but, the bolts are expensive and are labour intensive to insert and remove.

The disadvantage of the previous formwork systems conclude that they were cumbersome, and costly in the way in which upright formwork panels have to be assembled and manually supported in their upright position or tied together with bolts or steel ties.

Fixing removal ties rods to hold the pair of parallel opposing panels together is restrictive, and a two person job. Reliable quality control checking points and wall insulation are difficult to introduce in known formwork systems, and, the majority of the work in known formwork systems require at least two persons, or heavy lifting machinery.

More recently, there has been proposed a method and apparatus for constructing walls of a building or other structure from pourable concrete method which overcomes many of the disadvantages of the prior art concrete construction methods. That method, invented by the inventor of the present invention, is described in the Applicant's Australian Patent No. 647783.

In short, that method comprises the following steps:

a) providing a foundation extending transversely on both sides of the wall to be formed;

b) providing at least one pair of parallel opposing panels for defining vertical surfaces of the wall to be formed along a wall line and for defining a wall cavity therebetween for receiving the pourable material;

c) securing top edges of the at least one pair of panels a preset distance apart with spacing means positioned outside of the wall cavity;

d) securing bottom edges of the at least one pair of panels to the foundation at the preset distance apart with securing means positioned outside of the wall cavity;

e) positioning reinforcing means outside of said wall cavity and securing the reinforcing means to outer surfaces of the at least one pair of panels; and, f) pouring pourable material into the wall cavity to form said wall, whereby the wall so formed is free from unwanted passageways and/or cavities generated by clips or other structure reinforcing the panels.

The apparatus described in Australian Patent No. 647783, comprises a combination for forming such walls including:

at least one pair of parallel opposing panels for defining vertical surfaces of the wall to be formed and for defining a wall cavity therebetween for receiving the pourable concrete material;

spacing means secured to top edges of the at least one pair of panels outside of the wall cavity and spacing the top edges a preset distance apart;

securing means secured to the foundation and bottom edges of the panels outside of the wall cavity securing the bottom edges of the panels the preset distance apart;

reinforcing means outside of the wall cavity and secured to outer surfaces of the at least one pair of panels;

whereby a wall formed in the wall cavity is free of unwanted passageways and/or cavities generated by the combination.

Whilst the method and apparatus described in the Applicant's Australian Patent No. 647783 provided significant differences and advantages over therebefore known building methods and apparatus utilising pourable concrete material, the inventor has now developed a significantly improved method an apparatus for building which has substantial advantages over the previous method.

The previous system relied on concrete foundations extending transversely on both sides of the wall to support pins that anchor the base of the external formwork. The system however has technical problems for small builders, as follows:

a) Using the concrete floor or foundations of the wall for pins to secure the base of the parallel opposing panels is unreliable, for three reasons;

I) concrete takes about 28 days to reach its strength;

ii) concrete mixes vary in strength from one supplier to another when the concrete is not up to strength it allows the pins to blow out causing a concrete spill from the wall cavity; and, iii) there is total reliance on the person placing and fitting the pins even if concrete strength is correct—one pin not upright or one hole not correct encourages a concrete blow out—this is unacceptable particularly for unskilled workers;

b) Setting up the formwork in its correct position is a cumbersome job and holding it in its correct position during the liquid concrete pour is a hit and miss situation, it is difficult to check if the formwork has moved slightly during the pour—an out of parallel wall is obvious only when internal door and cupboards are fitted;

c) When form panels are damaged slightly or particles of concrete are on the joining surfaces of the form panels, it causes a creep in the length of the wall when the panels are butted together, this in turn causes a problem in keeping the form panel wall to a specific lengths; and, d) The system is not flexible in that specific forms of different dimension are required for different length walls. The system does not allow for a variety of wall lengths without a change of form panel sizes.

SUMMARY OF THE INVENTION

The present invention therefore seeks to provide a building method and apparatus therefor which overcomes the known disadvantages of the prior art.

The present invention also seeks to provide a complete building method and apparatus to enable the new formwork to be used to pour columns, walls and beams. A raked roof beam may be poured in-situ connecting the walls of the building together giving greater stability and at the same time forming support for the roof purlins, roof claddings and ceiling materials.

The present invention also seeks to provide a complete building structure and method and apparatus therefor which reduces costs and reduces building time and gives greater structural stability.

The present invention also seeks to provide a building structure with quality control check points at various stages of the building method.

The present invention also seeks to provide a building method and apparatus therefor wherein all the formwork and assembly parts are reusable, and can be amortised over a long period of time.

The present invention also seeks to provide a building method and apparatus therefor wherein one person can carry out the majority of the work in erecting and dismantling the formwork.

The present invention also seeks to provide a building method and apparatus that will enable the door openings to be designed and moulded in shape to receive the door, thus providing a fire-rated door surround with the hinge base and striker plates insert moulded in position in the door surround.

The present invention also seeks to provide a building method and apparatus therefor, whereby the internal portion of the concrete wall can be used as a thermal mass to store and release energy. Insulation may be provided internally in the wall to thermally insulate the outside of the wall from the inside of the wall, to better resist the transfer of varying temperatures and noise through the walls and/or to prevent condensation from permeating the walls due to variation of inside and outside temperatures.

In one broad form, the present invention provides a method of constructing formwork for forming column(s), wall(s), beams and/or the like using pourable concrete material, comprising the steps of:

(a) positioning and securing base portion formwork atop foundation means, each said base portion formwork being comprised of a pair of opposing base panels defining the base portion surfaces of said column(s), wall(s) or the like to be formed;

(b) positioning and securing upper portion formwork(s) of said wall(s) formwork atop of said base portion formwork(s), each said upper portion formwork(s) being comprised of at least one pair of substantially parallel opposing upper panels defining the upper portion surfaces of said wall(s) to be formed, wherein said formwork is constructed by positioning said upper panels atop of base portion formwork and securing top edges of said upper panels with a spacing means located outside said formwork panels.

In a preferred form, in step (a), after positioning and securing of said base portion formwork, pourable concrete material is supplied between said base panels and allowed to set prior to said positioning and securing of said upper portion formwork of step(b), whereafter, pourable concrete material is supplied between said upper panels and allowed to set.

In another preferred form, following step (b), after positioning and securing both of said base portion formwork and said upper portion formwork, pourable concrete material is concurrently supplied between both said base panel and said upper panels and allowed to set.

Preferably, at least the base portion of corner and/or column sections of said wall(s) are constructed prior to intermediate sections of said wall(s).

Preferably, prior to pouring said concrete material, window, door and/or other opening blanking panels are provided at predetermined positions in said wall section formwork such that concrete material is prevented from being provided into such positions.

Also preferably, said corner portions are constructed by positioning said walls formwork panels, atop of base portion formwork and securing top edges of said wall formwork panels with a spacing means located outside said formwork panels and securing blanking panel formwork to said corner formwork panels via C-clamp means located outside said formwork panels.

In a preferred form, said wall base formwork comprises a pair of parallel opposing base support frames, each frame, having a lower end adapted to engage with a blanking panels or a support ridge or the like associated with said foundation, and an upper end adapted to receive said wall section formwork, said base frame being provided on one side of said frame substantially between said upper and lower ends thereof to define an exterior concrete surface.

Most preferably, said wall base frame further comprises a pressure release means provided in an upper portion of said frame, to permit the release of pourable material and/or air and other gases which may enter the lower end of the frame during the pouring process.

In a preferred embodiment, opposed base frames are retained in position by locking pins, which are preferably tapered for ease of removal thereof after said pourable material is set.

Preferably, said base frames are retained in position by being secured together by use of end panels and one or more removable C-clamp.

Preferably, atop end of each parallel opposed wall section formwork is retained in position by a wall spacing support clip.

Preferably, insulation is positioned in the concrete wall to insulate the outside surface from the inside surface and at the same time maximise thermal advantages.

Preferably, said foundation means comprises a substrate surface, a slab, including a raft slab, and/or foundation piers.

In a preferred embodiment, the method of construction further comprises the step of:

(c) positioning and securing formwork for one or more horizontal or raked beam atop said upper portion formwork.

In a further broad form, the present invention provides a combination for forming one or more column, wall, or the like, from pourable concrete material, comprising:

base portion formwork, adapted to be secured atop foundation means, each said base portion formwork comprising pairs of opposing base panels defining base portion surfaces of said column, wall or the like to be formed; and upper portion formwork, adapted to be secured atop said base portion formwork, each said upper portion formwork comprising a pair of opposing upper panels defining upper portion surfaces of said column, wall or the like to be formed.

Preferably, said base portion formwork(s) and said upper portion formwork(s) are configured to form columns, straight sections, corner sections and/or intermediate sections of said wall(s).

Preferably, the combination further comprises wall and blanking panel, window, door and/or other opening blanking panels are provided at predetermined positions in said wall section formwork such that concrete material is preferred from being prevented into such spaces.

In a further broad form, the present invention provides a wall base formwork frame comprising a lower end adapted to engaged with a blanking panel or a support ridge provided with said foundation and an upper end adapted to receive said wall section formwork, and a base panel provided on one side of said frame substantially between said upper and lower ends to define an exterior concrete surface.

Preferably, the base formwork frame further comprises a pressure release means provided in an upper portion of said frame to permit the release of pourable material and/or air and other gases which may enter the lower end of the frame during the pouring process.

BRIEF DESCRIPTION OF THE DRAWINGS

The present invention will become more fully understood from the following detailed description of the preferred but non-limiting embodiment thereof, described in connection with the accompanying drawings, wherein.

DETAILED DESCRIPTION OF PREFERRED EMBODIMENTS

Figure 1A:
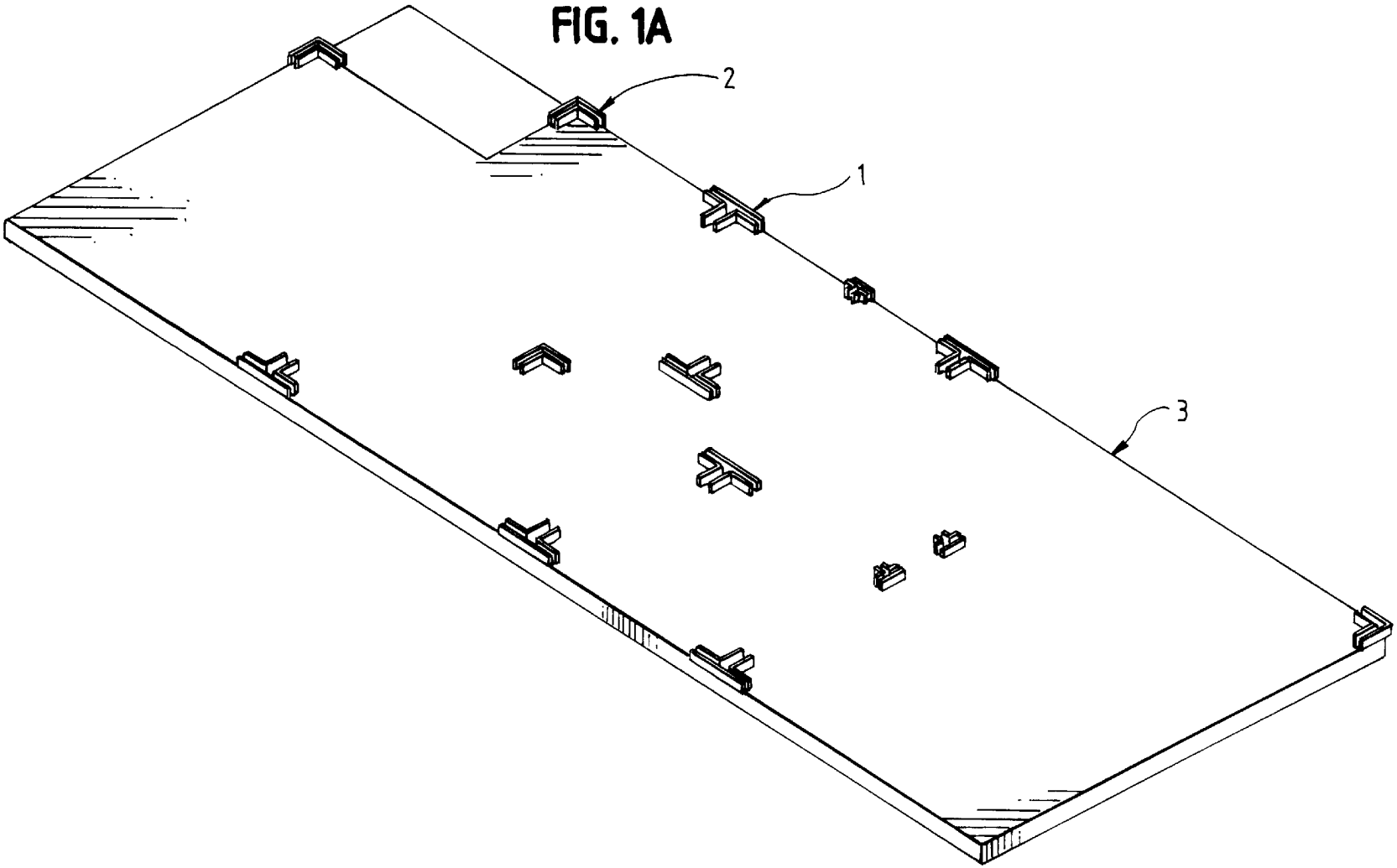
FIG. 1, in FIGS. 1A to 1E, illustrate the basic steps of forming a building structure, in accordance with a preferred embodiment of the present invention.

Throughout the drawings, like numerals will be utilised to identify similar features, except where expressly otherwise indicated.

In reading this specification, it is assumed that the reader is well aware of standard building techniques. It is also assumed that the reader has read and understood the Applicant's Australian Patent No. 647783, the disclosures of which should be considered to be incorporated entirely herein by this reference thereto.

It should also be clearly understood, that whilst various system components, and methods of construction are described herein to produce a composite building method and apparatus, the separate components and the separate methods of construction are able to be utilised separately. Therefore, it should be clearly understood that the invention is not limited to the composite system and method as hereinafter described, but also to the separate components and methods.

As shown in the drawings, the components of the building system in accordance with the present invention, comprise a number of sub-components. The primary components will be more fully described hereinafter.

In FIG. 1, five primary steps of the building method, in accordance with a preferred embodiment of the invention, are shown in FIGS. 1A to 1E.

The first step in the construction method, as shown in FIG. 1A, is to set out the building position and decide on the type of foundation. Various types of foundation may be used, including a slab, a raft slab, piers, beams between piers, or, a subterrain surface. The position of the wall corners and columns, both external and internal, are then determined and the corner/column base channel formwork is positioned atop of the foundation, as illustrated.

Figure 1B:
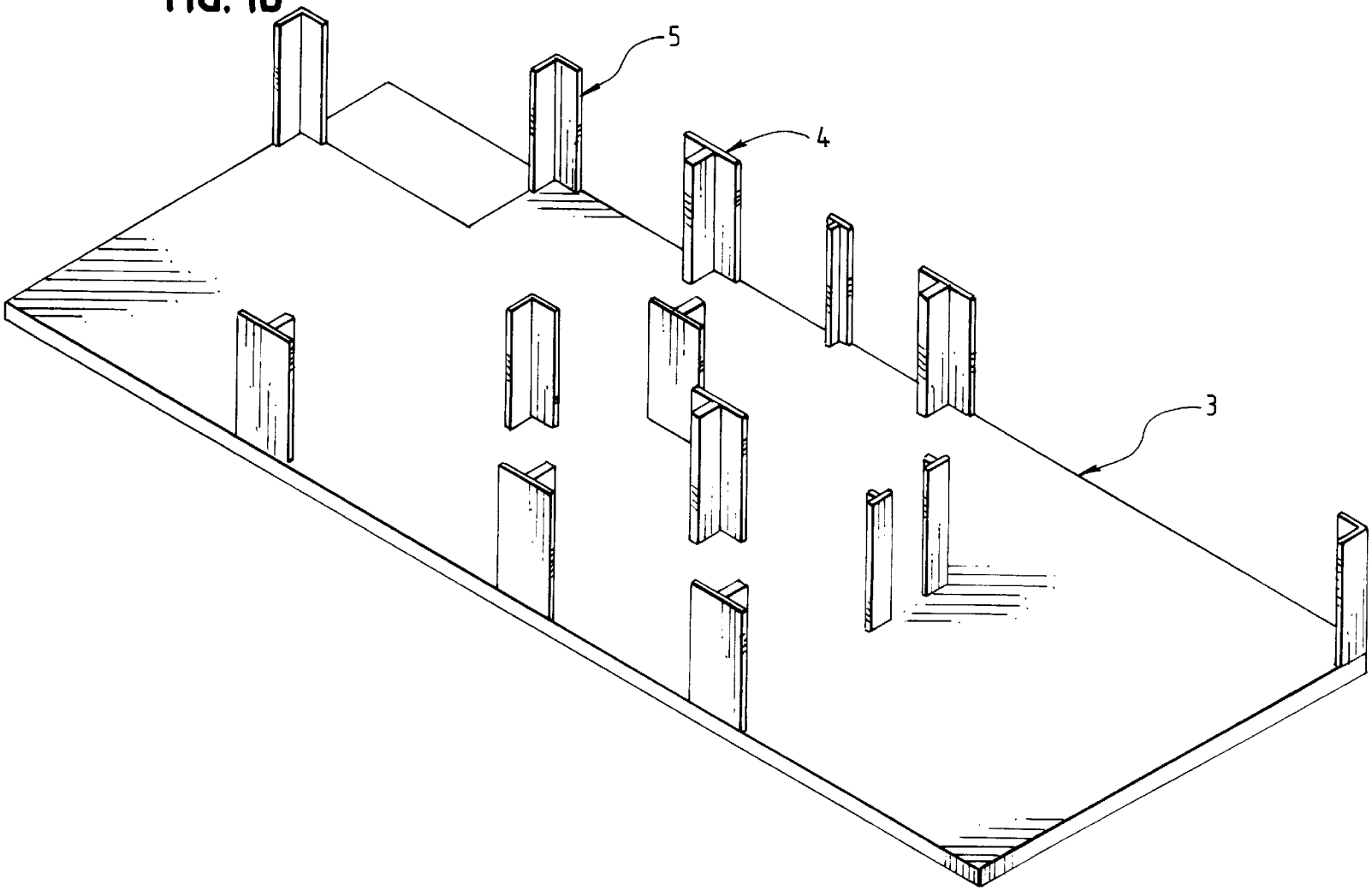

The corner/column base channel formwork may be poured with concrete and permitted to set in position, or, the upper corner or column formwork panels then be constructed, and then concrete material is poured into the base and upper formwork and permitted to set at the same time, as shown in FIG. 1B. Once the corners are set, the corner formwork is removed.

Figure 1C:
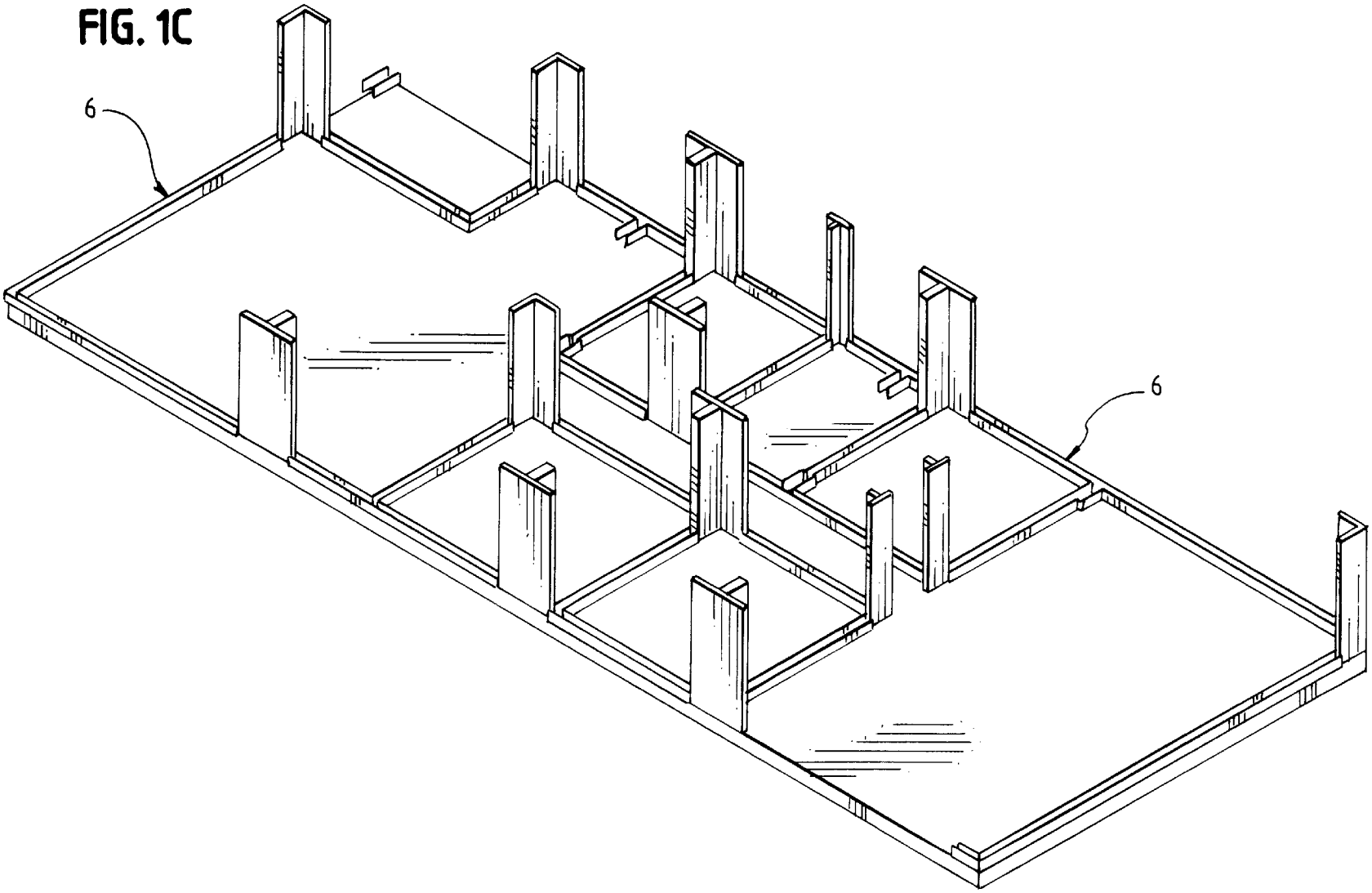

The third step, as shown in FIG. 1C, is to position the wall base support channels between the wall corners/columns. The wings of the wall corners are the same thickness as the wall cavity. This allows for a slidable adjustment of the base support channels to fit between the corners to suit variations in the distances of the wall lengths, enabling standard length formwork to suit varying wall lengths, as will be described hereinafter with reference to FIG. 8.

Figure 1D:
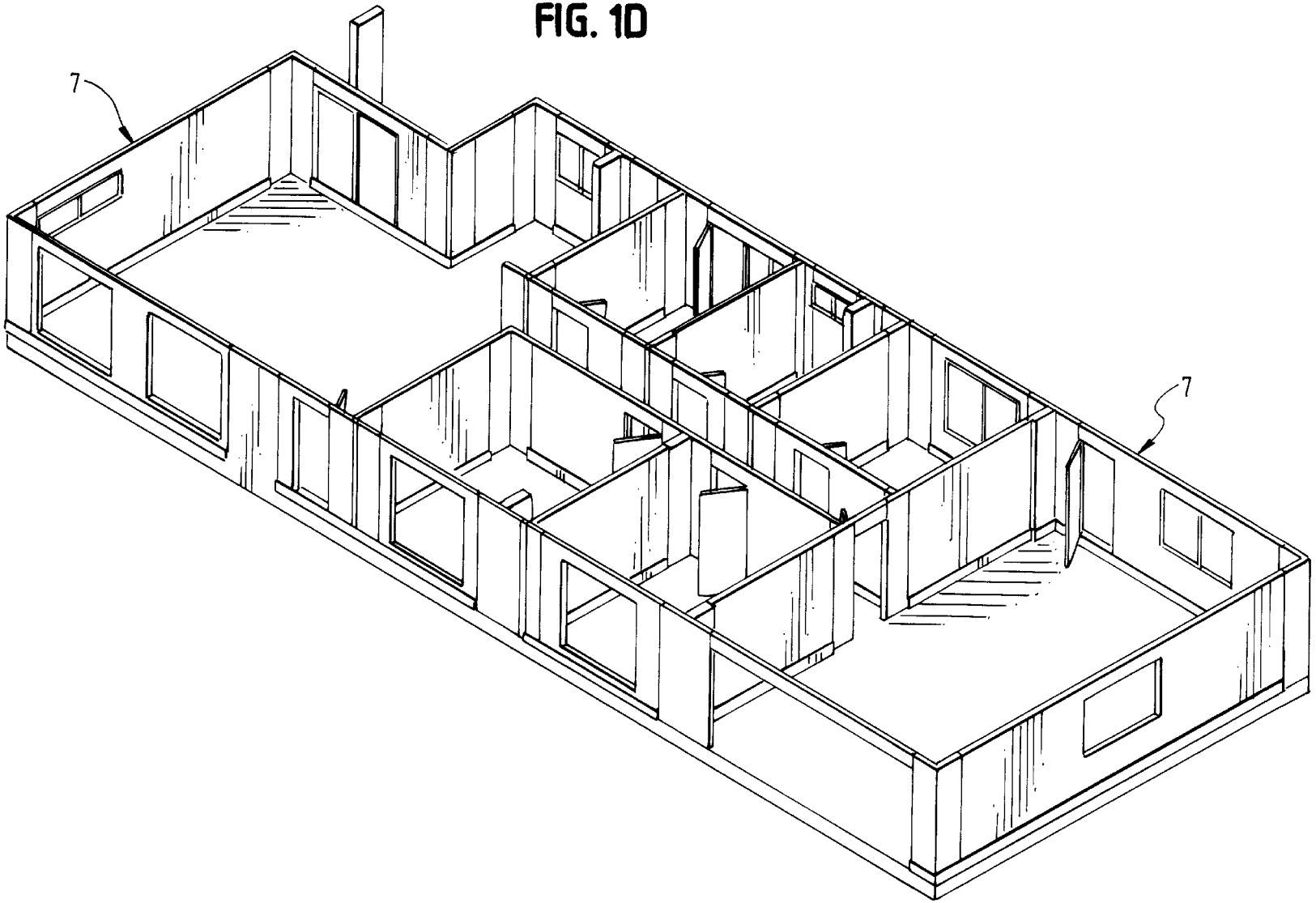

Once the base formwork is fixed in position and secured to the corners it may be poured with concrete to construct the base wall portion which will then support the upper wall liquid concrete, or, the wall panel formwork may be simultaneously formed and then both the base and the upper wall portion are poured at the same time and allowed to set together, as shown in FIG. 1D. Once the wall concrete is set the wall and base formwork are removed.

Figure 1E:
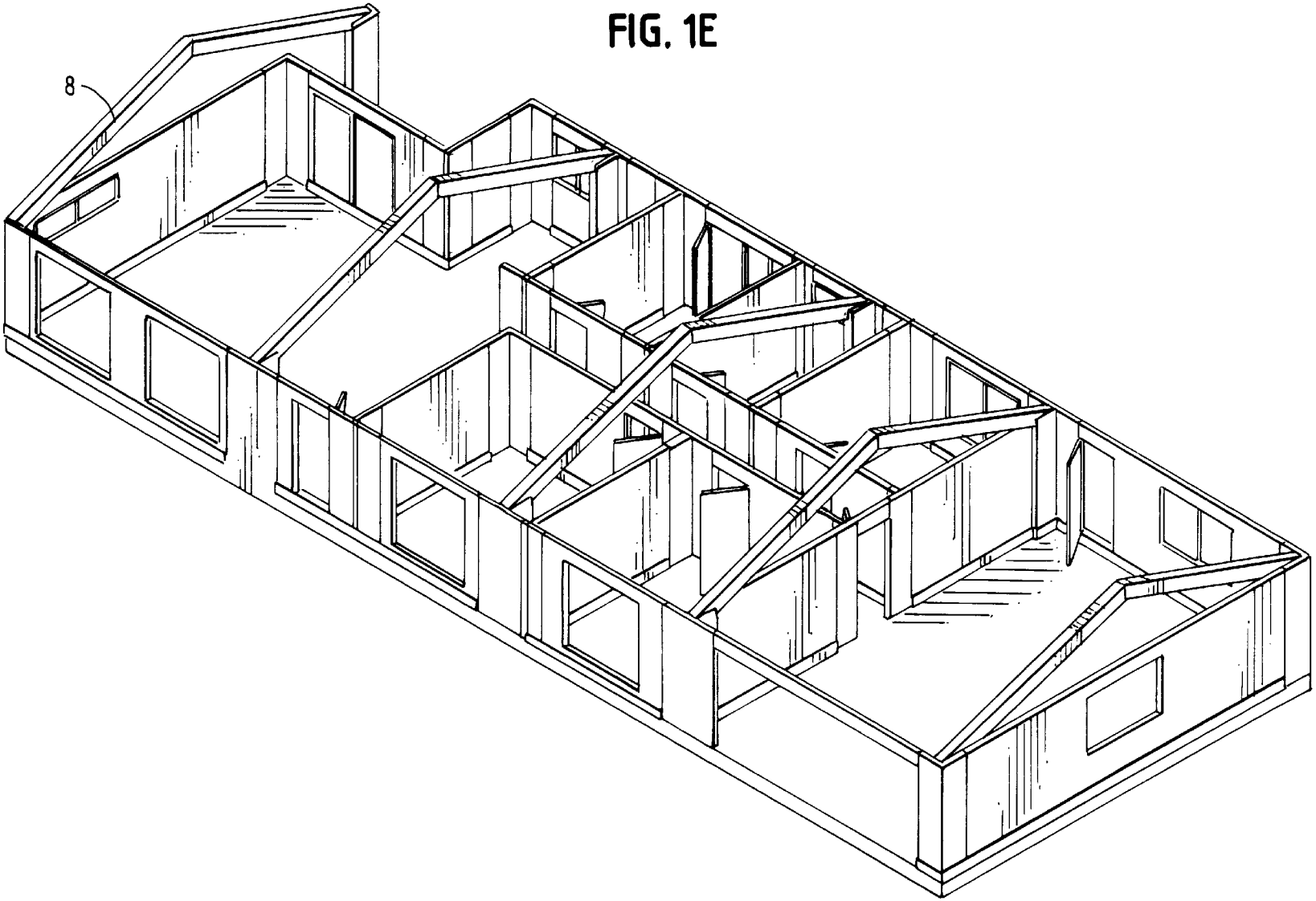

A final step, as shown in FIG. 1E, is to attach beams atop the walls, to provide added stability and strength to the building structure. The beams may also support the roof and ceiling materials.

Further and fuller details of the components and the method of construction will be hereinafter described.

As briefly mentioned hereinbefore, the first step in the best known system of the present invention, as shown in FIG. 1A, is to position the base portion formworks 1 and 2 atop the foundations 3. As shown, the base portion formworks are generally T-shaped, as shown by numeral 1, or L-shaped, as shown by numeral 2. Of course, other shaped columns and corners may alternatively be utilised. The foundation 3 may comprise a slab type foundation made of concrete or another type of substrate surface. Alternatively, foundation piers may be provided at the appropriate positions under the corner and/or column base channels. Further details of the base formworks are shown in FIGS. 2, 3, 4 and 5, and will be described hereinafter.

The second step in the method is to provide the upper portion formworks for the columns and/or channels such that ultimately the columns and channels 4 and 5 are formed on the foundation 3. Once again, the columns are generally constructed to be of T-shaped 4, or L-shaped 5, but could be of any other shape, depending upon the geometries of the building and the rooms. The upper portions of the columns and/or corners may be poured simultaneously with the base portions, or separately therefrom. That is, prior to forming the upper portions, concrete could be poured in the base formworks illustrated in FIG. 1A, and permitted to set, prior to attaching the upper portion formworks and then pouring the concrete therein, to form the columns and corners. Alternatively, the upper portion formwork could be attached to the base channel formwork, and then the concrete could be poured into both the base and upper formworks simultaneously, and then allowed to set. Once the corners and columns have set, the positioning of the intermediate base channel portions 6 of the intermediate wall sections may easily be performed, as shown in FIG. 1C. The concrete can optionally be poured in the base portions 6 intermediate the columns and corners, or, the upper portion formwork 7 of the intermediate wall portions may be positioned atop the base portion formwork and then concrete poured simultaneously in both the base and upper formworks of the intermediate wall portions, with the resulting configuration as shown in FIG. 1D.

Beams, either horizontal or raked, identified by the reference numeral 8 in FIG. 1E may then be formed. These beams give added stability and strength to the building structure, and may also support the roof and ceiling materials. Step 5 as shown in FIG. 1E is basically the final step in the casting procedure. It will be obvious to persons skilled in the art that windows, doors, roof, ceiling materials, and other features may then be added in accordance with normal building practices.

Figure 2A:
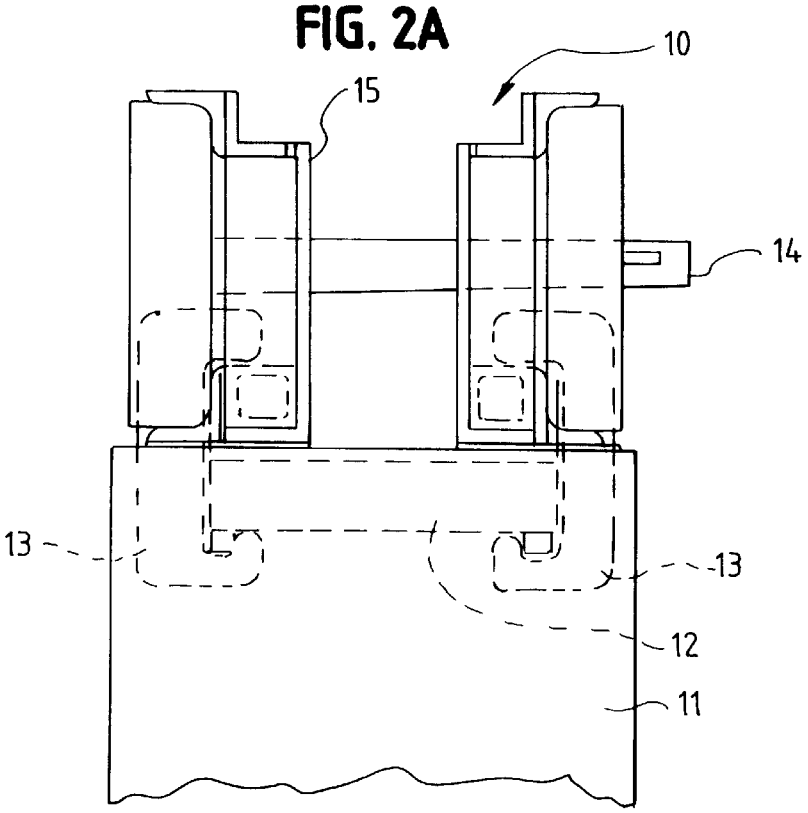
FIG. 2 shows, in FIGS. 2A and 2B, end and elevational views of the base portion formwork resting on a pier.
Figure 2B:
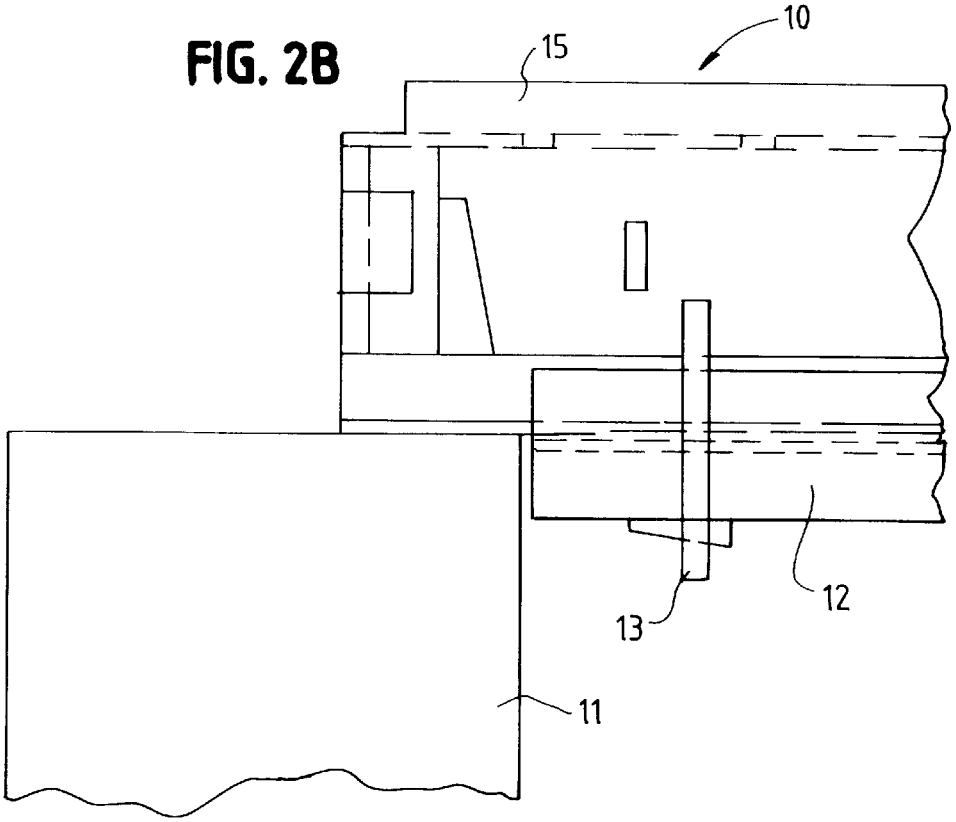

FIGS. 2A and 2B illustrate end and elevational views of the base portion formwork 10 resting on a pier 11. As seen, the blanking panel 12, forming the underside of the formwork, stops short of the pier 11. FIG. 2A shows how C-clamps 13 and tapered locking pins 14, details of which are shown in FIGS. 14 and 15, are used to retain the various base formwork panels 12 and 15 in position whilst the concrete is poured.

Figure 3A:
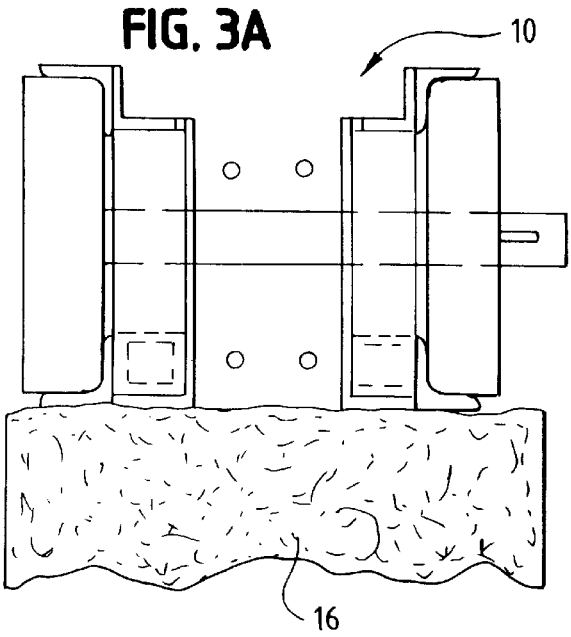
FIG. 3 shows end views of the wall base portion in contact with onto various substrate/foundation surfaces, FIG. 3A showing the base portion directly on a substrate surface, FIG. 3B on an edge portion of a concrete slab, and, FIG. 3C on top of an existing concrete wall.
Figure 3B:
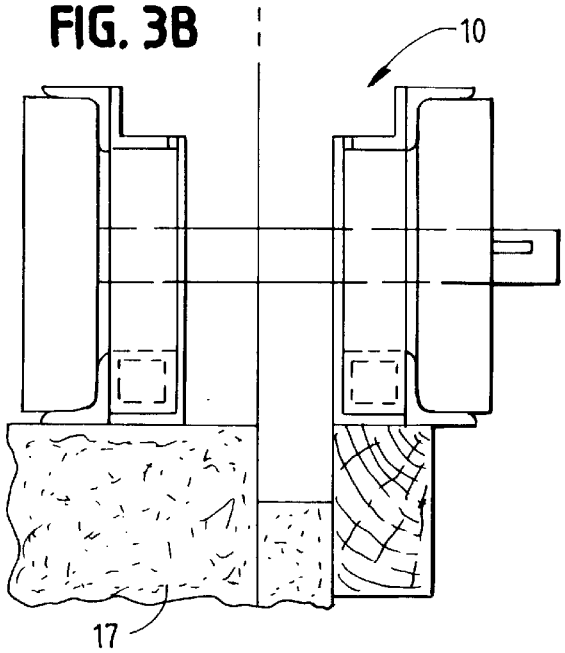
Figure 3C:
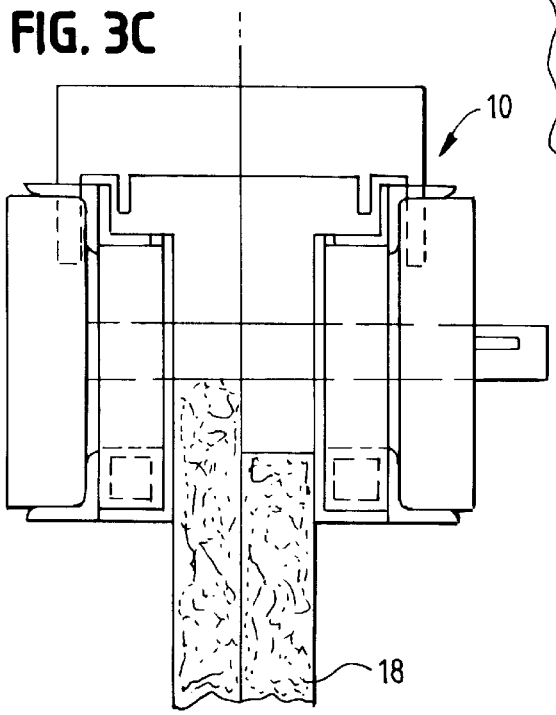

FIG. 3 illustrates the different types of foundations upon which the base frameworks 10 may be situated, FIG. 3A illustrating base formwork 10 on a substrate surface 16, FIG. 3B illustrating the base formwork 10 on the edge of a concrete slab 17, and FIG. 3C illustrating the base formwork 10 on an existing wall 18. Other modifications of the attachment of the base formwork 10 to other types of foundations or substrate surfaces will become obvious to persons skilled in the art.

Figure 4:
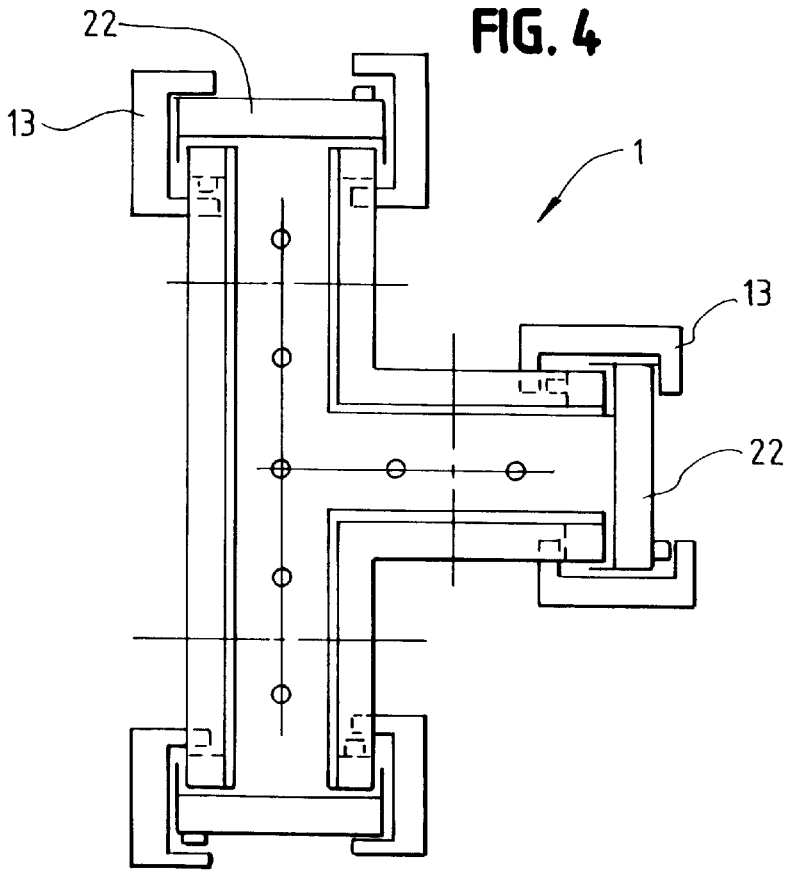
FIG. 4 illustrates, in a plan view, the components required to construct the base channels and/or the form panels of a T-shaped column.
Figure 5:
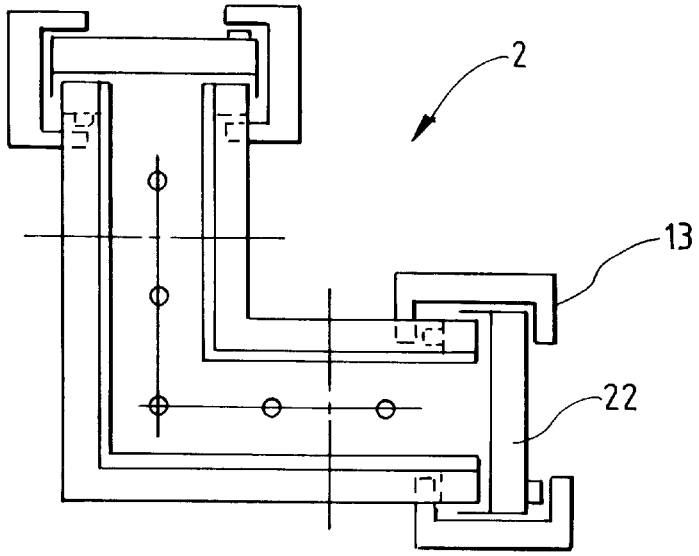
FIG. 5 details the components required to construct the base channels and/or the form panels of an L-shaped column.
Figure 6A:
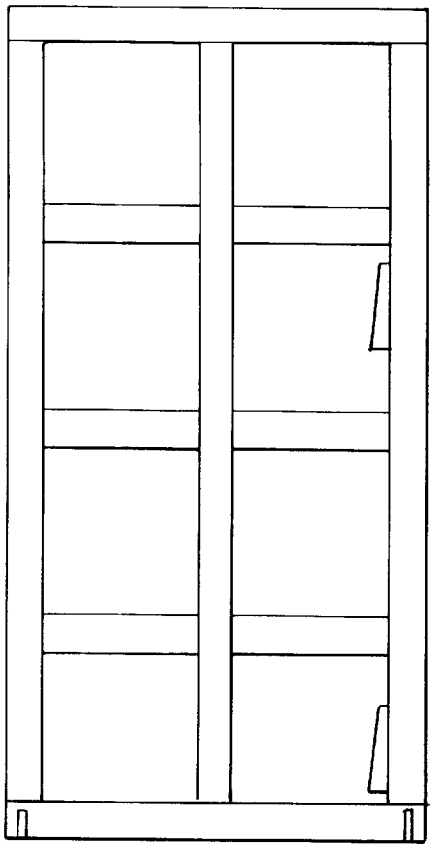
FIG. 6 details in FIGS. 6A to 6G plan and elevational views of the various wall formwork panels used in the method of the present invention.
Figure 6B:
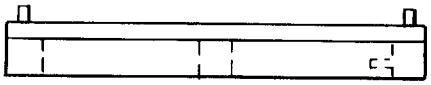
Figure 6C:
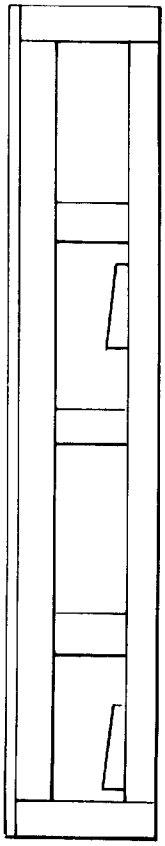
Figure 6D:
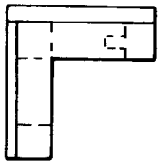
Figure 6E:
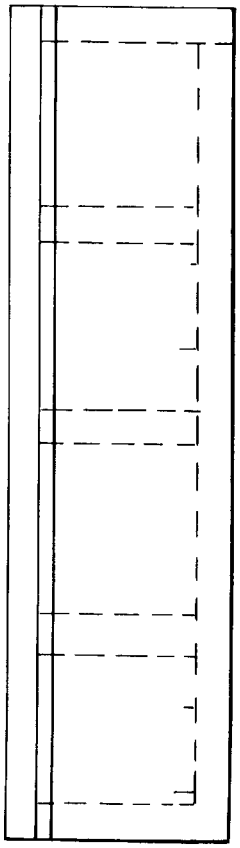
Figure 6F:
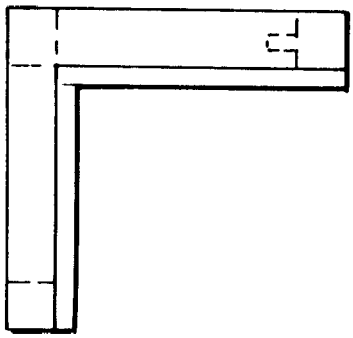
Figure 6G:
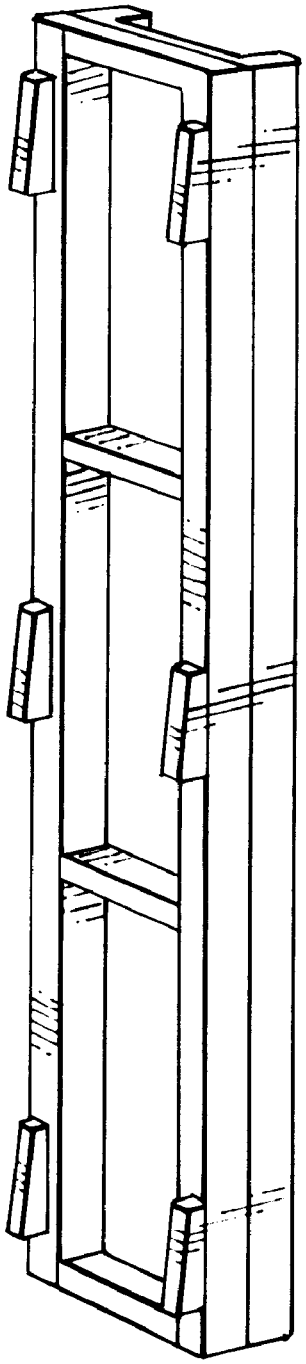

FIGS. 4 and 5 illustrate more detailed plan views of the formwork used in the base and/or upper sections of the columns or corners, FIG. 4 illustrating the formwork for constructing a T-column and corner section, and FIG. 5 illustrating the formwork for constructing an L-shaped corner or column. It will be noted that C-clamps 13 are used to retain end panels 22 to the corner or column formwork.

FIG. 6 illustrates details of various preferred embodiments of the upper formwork panels, showing the constructional details therefor and the features thereof for interconnection. FIGS. 6A and 6B show elevational and plan views, respectively, of a standard form panel, FIGS. 6C and 6D show elevational and plan views of an internal corner panel, FIGS. 6E and 6F show elevational and plan views of an external corner panel, and, FIG. 6G shows a perspective view of a blanking end panel.

Figure 7:
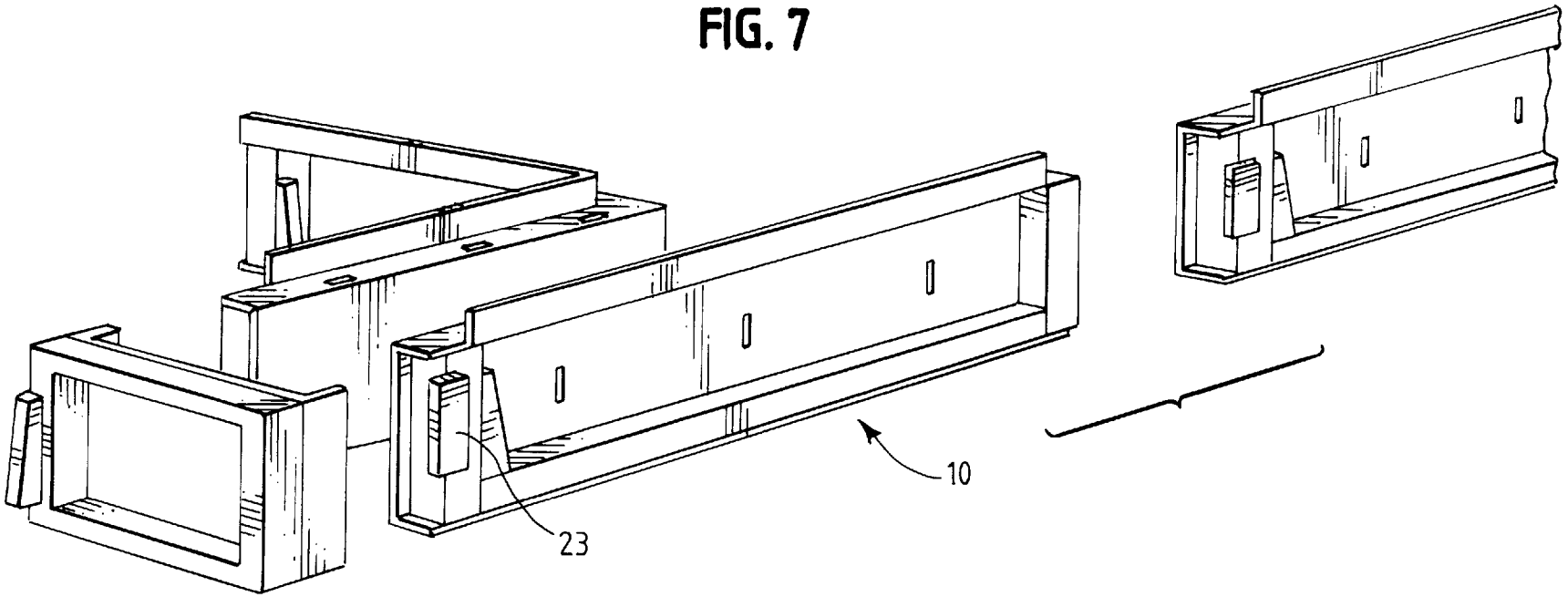
FIG. 7 illustrates an exploded perspective view of the base portion components used to construct base portions of the walls.

As shown in FIG. 7, each of the base panels are adapted to be interlocked together by means of suitable interlocking means 23. Numerous different variations to the interlocking means will become apparent to persons skilled in the art, and all such variations should be considered to be within the scope of the invention. The arrangement of panels shown in FIG. 7 shows a base channel with a corner for a T-section, and a blanking end.

Figure 8:
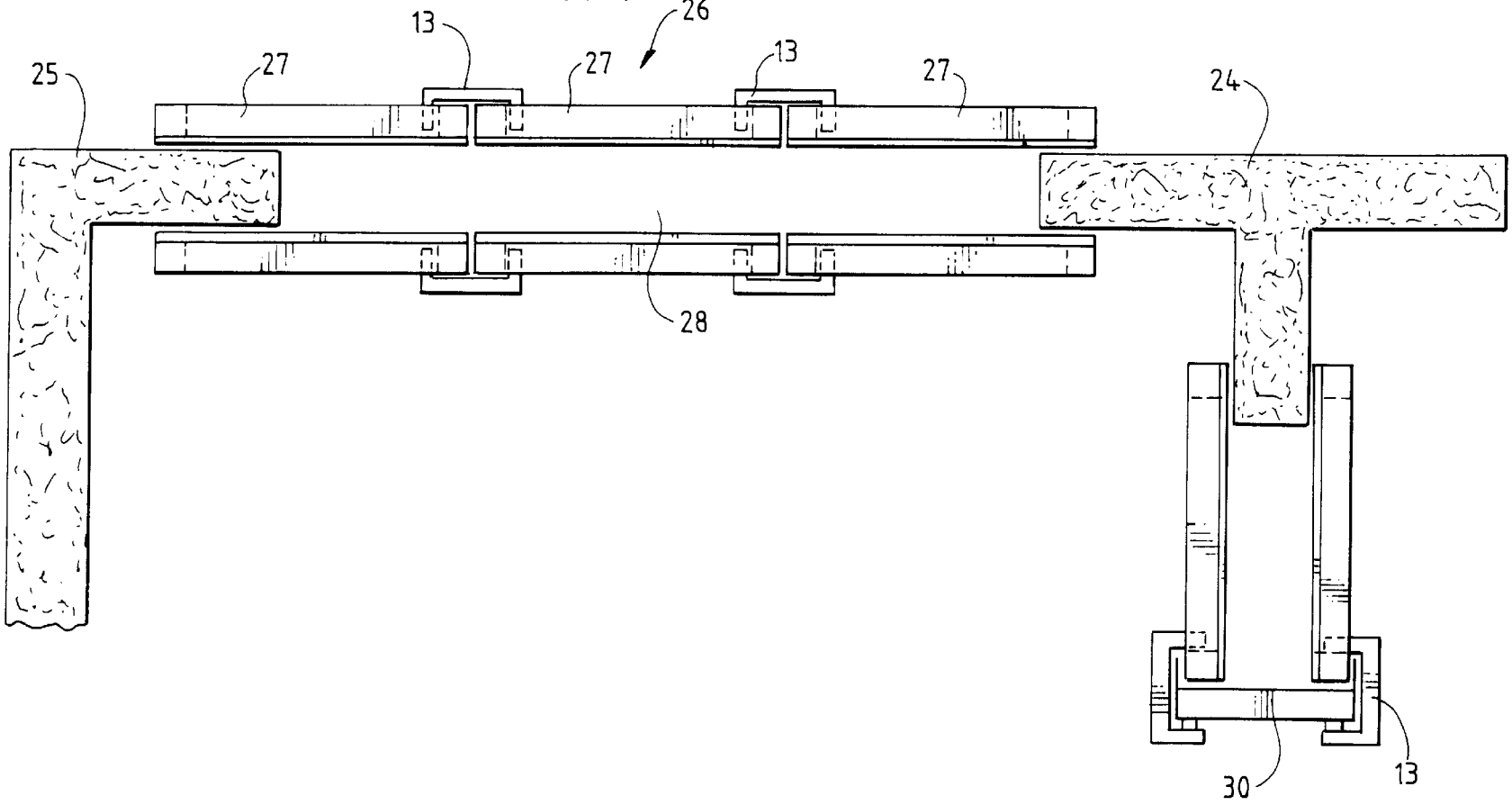
FIG. 8 illustrates a plan view of the components forming the intermediate wall portions between columns/corners.

FIG. 8 illustrates how once the corners and/or columns 24 and 25 are cast, the intermediate section formworks are attached thereto, for ultimate casting of concrete within the cavity 28. A plurality of panels 27 are secured together by suitable clamps 13. End panels 30 are also provided where needed.

Figures 9A, 9B, 9C:
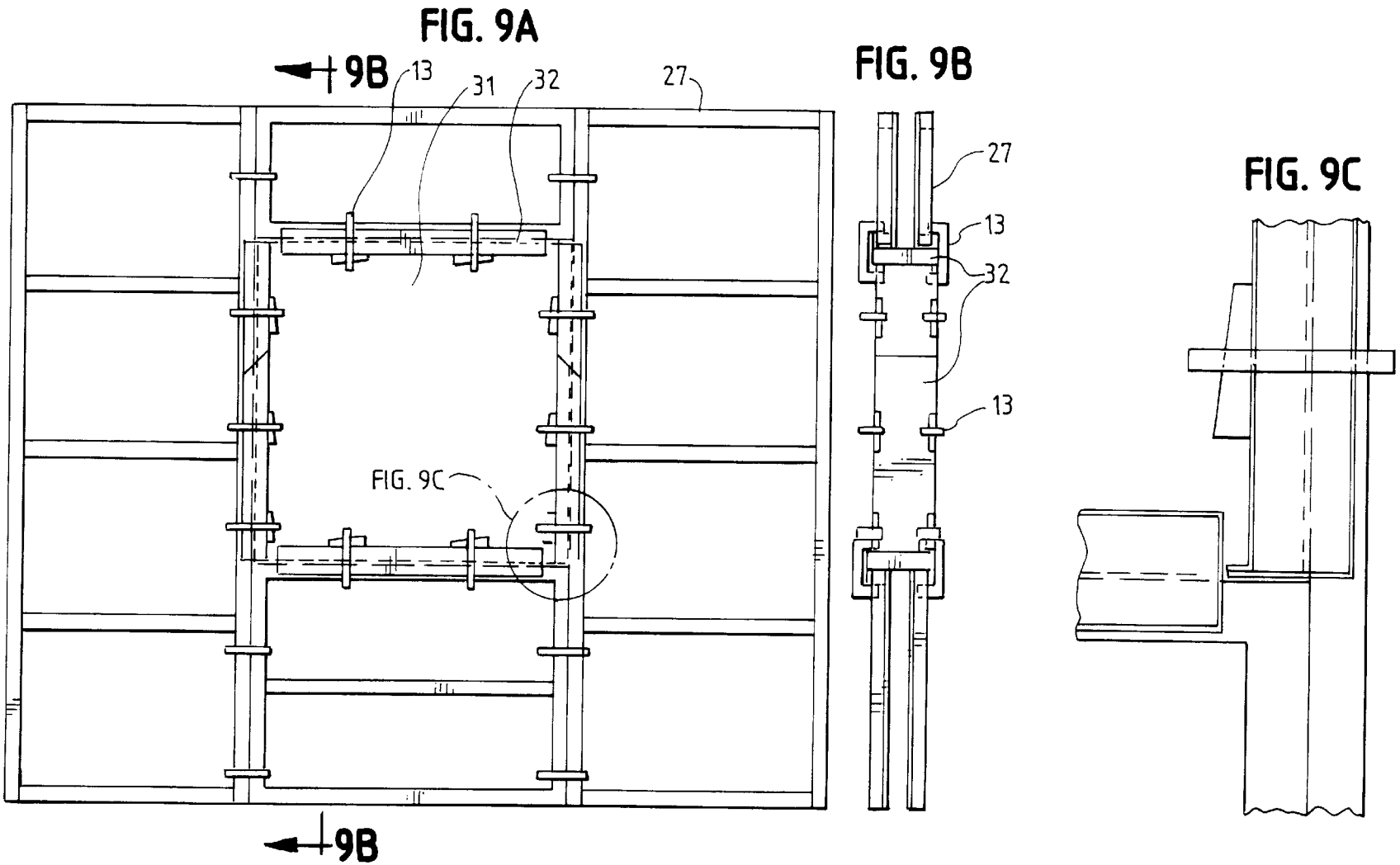
FIGS. 9A to 9C illustrate elevational, end and a detailed view of the components to form the intermediate wall portions, providing for a window or like opening.

As shown in FIGS. 9A to 9C, as window opening 31 may be provided in a wall by provision of appropriate panels 32, to prevent the concrete from being provided in the area 31. Once again, this may be achieved in various ways, as will be clearly understood to persons skilled in the art. FIGS. 9A and 9B illustrate elevational and cross-sectional views of the window opening 31, showing that each side of each door, window or the like is provided with a pair of panels 32. The abutting ends of each pair of panels or blanking members is shown in FIGS. 9A and 9B to terminate in a correspondingly shaped transverse member to permit easy assembly/disassembly. FIG. 9C details the connection between the side and top/bottom panels, showing that a small gap is provided to enable disassembly of the panels. As will be understood to persons skilled in the art, concrete contracts when it hardens. Therefore, provision of the gap, together with forming a break point in the side panels, permits the easy dissassembly of the panels once the concrete has hardened. The break point may be formed with an angle join as shown in FIG. 9A, or, by an analogous means which may be obvious to a person skilled in the art.

Figure 10:
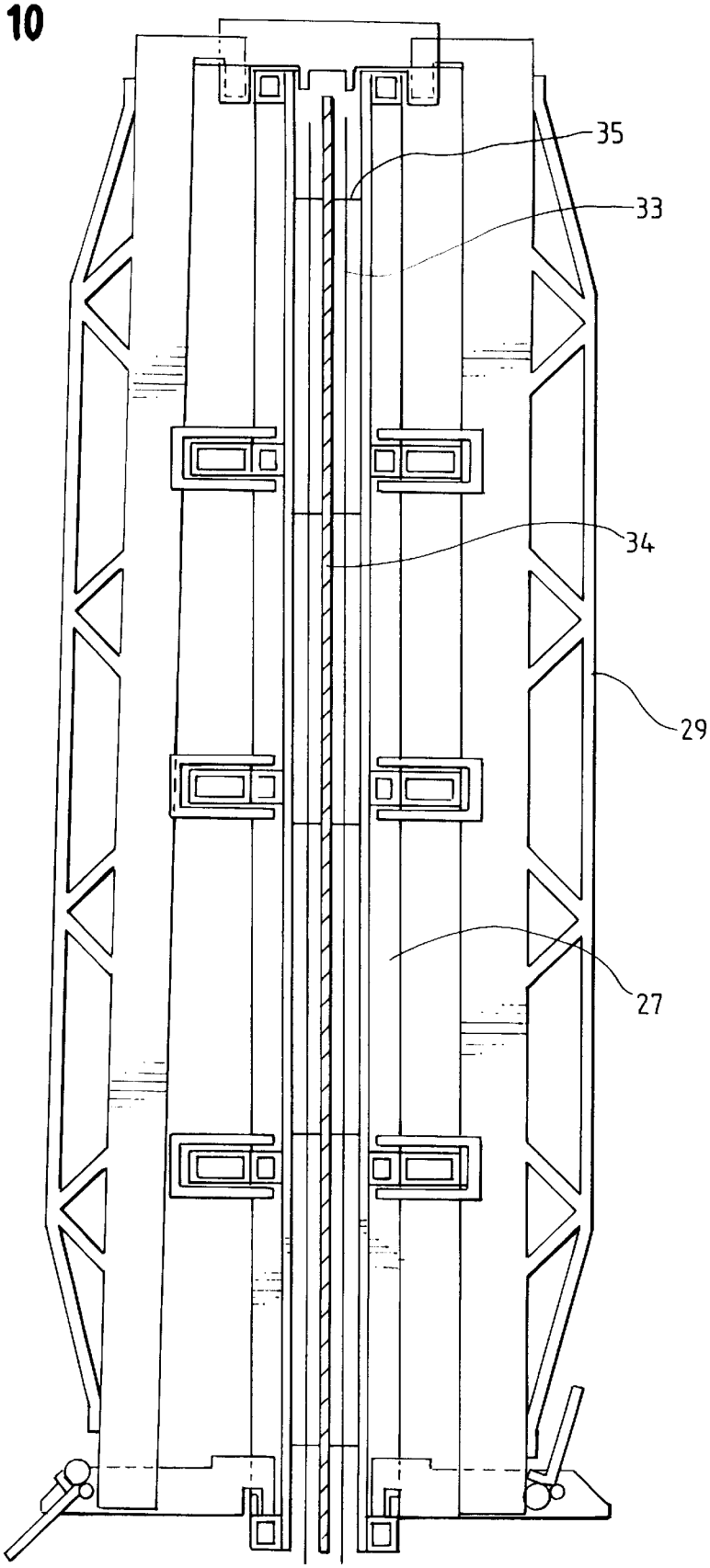
FIG. 10 shows a cross sectional view of the components to form a wall, with external bracing used for support during construction.

FIG. 10 illustrates how trusses 29 are provided on the exterior of the formwork to maintain the formwork in position during pouring of the concrete. FIG. 10 also illustrates the provision of the reinforcing bars 33 and thermal insulation 34 within the cavity. Steel support chairs 35 may be provided to maintain the reinforcing steel 33 in position.

Figure 11A:
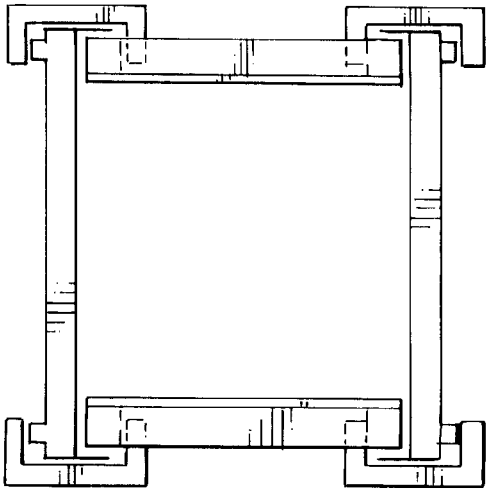
FIGS. 11A to 11C detail various alternative uses of blanking panels.
Figure 11B:
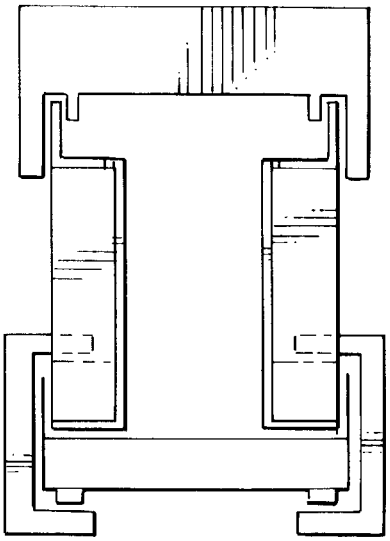
Figure 11C:
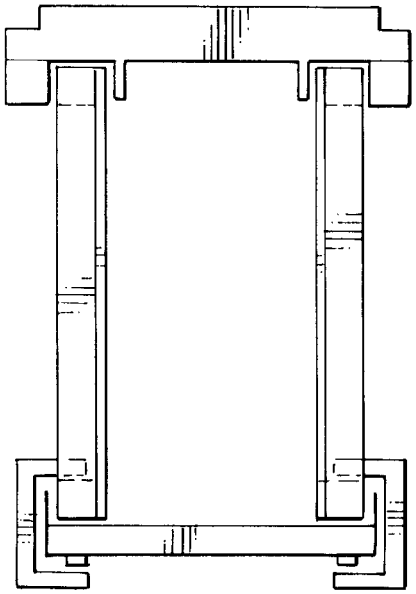

FIG. 11 illustrates details of various blanking panels and how they are interconnected to form columns and beams. It will be understood that where windows, doors and other openings are required, blanking panels, such as shown in FIG. 11 are provided at appropriately predetermined positions. The blanking panels may be provided in various lengths, depending upon the size of the opening. Appropriate clamps and wedges may be utilised to secure the blanking panels into position. FIG. 11A illustrates upper and lower form panels, and said blank panels, joined to form column formwork, FIG. 11B illustrates panels joined to form base channel beam formwork, and FIG. 11C illustrates alternative beam formwork panels.

Figure 12:
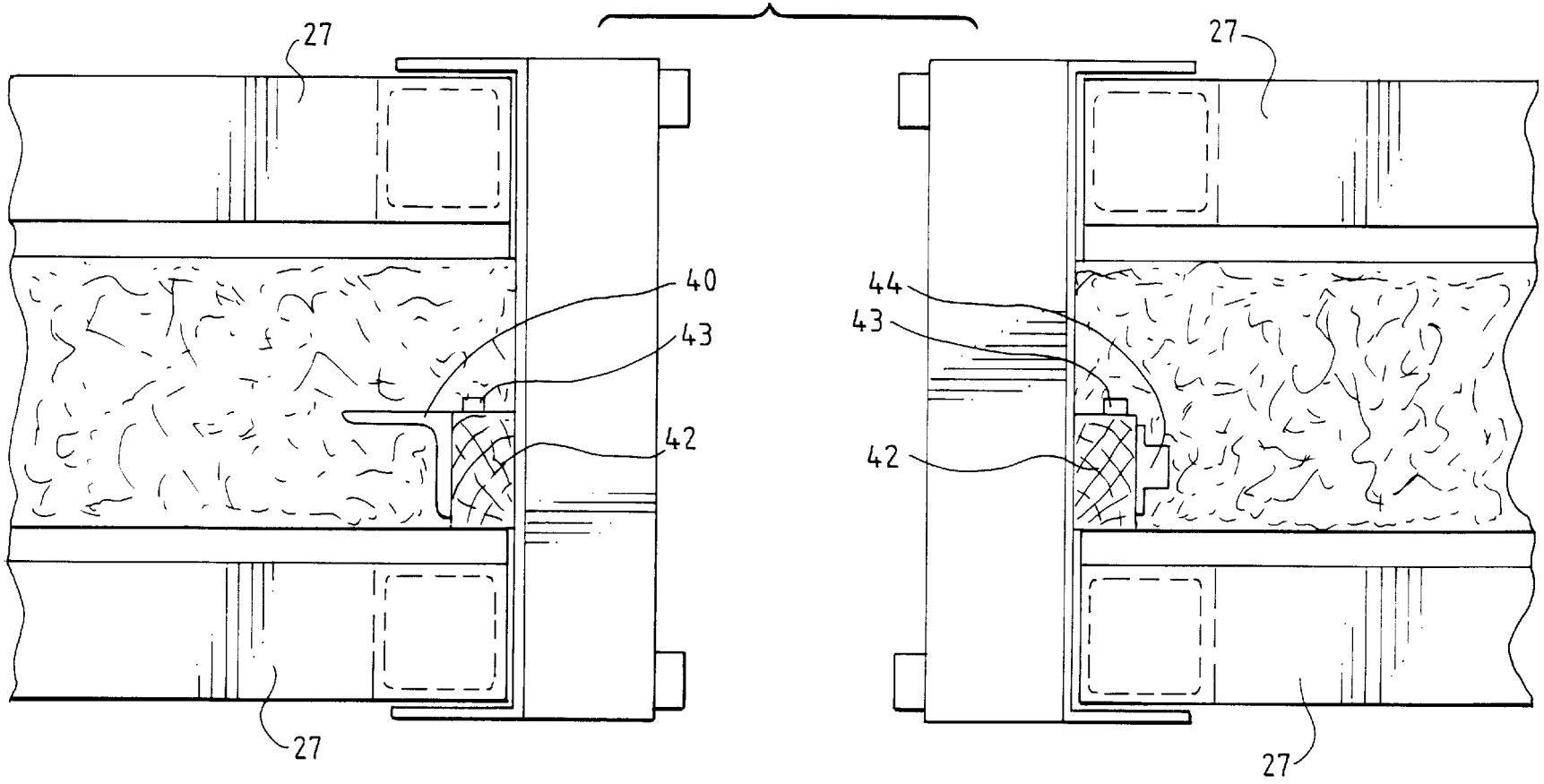
FIG. 12 illustrates a plan view of a door opening showing the hinge support bracket and door striker plate set in position.

In FIG. 12, is illustrated a cross-sectional plan view of the way in which a door opening may be formed. The left half of FIG. 12 shows the provision of a L-shaped steel or like section 40, being provided between the form panels 27, retained in position by a timber support 42. Also shown is a shaped member 43, which, after casting, provides an insertion slot to provide a felt, rubber, or like seal, giving a smoke proof seal and enabling a smooth door closing action. Once the concrete is cast and the formwork panels are removed, it will be appreciated that the L-section 40 remains, allowing attachment of the door hinges thereto. Likewise, the right half of FIG. 12 shows the positioning of a striker plate 44.

Figure 13:
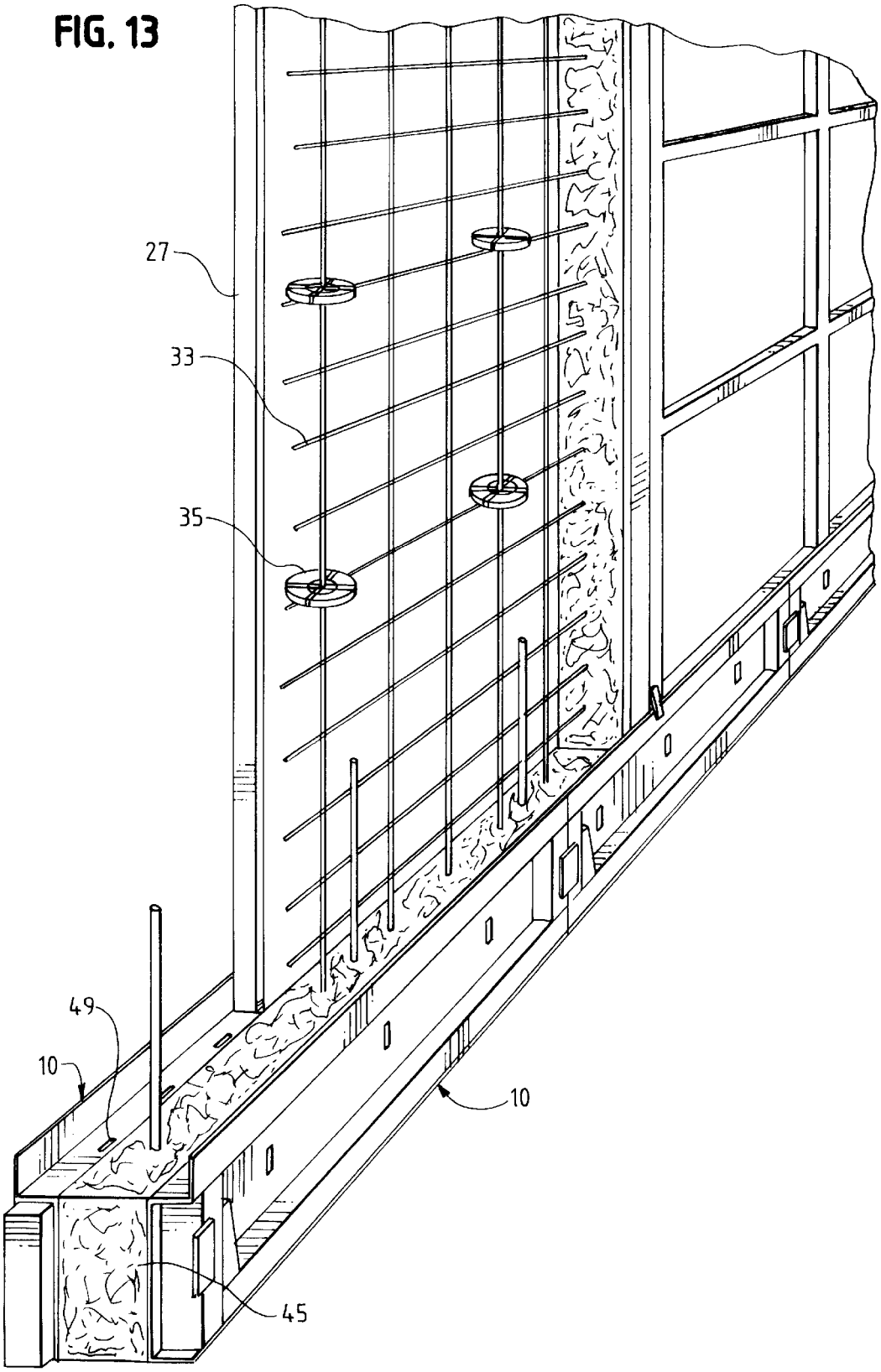
FIG. 13 illustrates a perspective view of the formwork constructed to permit a quality control check to be carried out, showing the reinforcement in position.

FIG. 13 illustrates a partial assembly of the formwork components, including reinforcement steel 33, spacers 35 therefor, and service connections for plumbing, electrical, wiring, etc., ready for a quality control inspection. It will be appreciated that by leaving one side panel of the formwork missing from the components, such components may be easily inspected by regulatory authorities, etc., prior to the pouring of the concrete.

Also illustrated in FIG. 13 is the provision of a pressure release slot 49.

As the inventor has identified, pourable concrete material is prone to escape from the desired cavity space 45, and particularly underneath the lower edge of the front base panel, to create a hydraulic lifting action especially desired pressure release gap 49 may optionally be provided in an upper portion of the base formworks 10 to allow escape or such liquid concrete, and consequently prevent the base formwork 10 from being displaced from it's desired position.

Figure 14A:
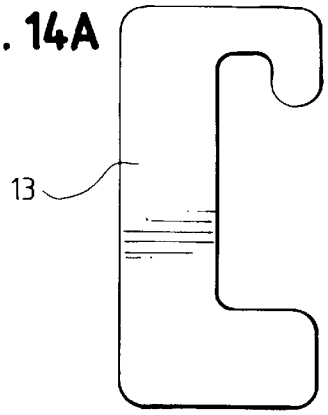
FIG. 14 details, in FIGS. 14A and 14B, a C-clamp.
Figure 14B:
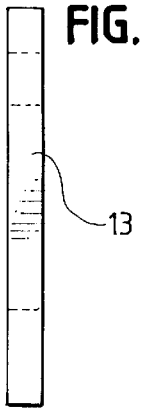

In FIG. 14 is shown, in FIGS. 14A and 14B, side and end views of a C-clamp 13 which may be used for joining various panels in the present invention.

Figure 15A:
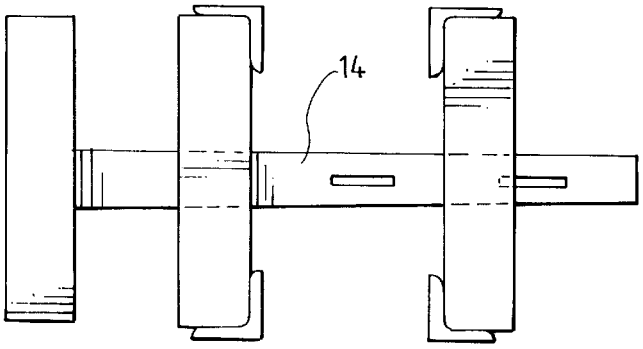
FIGS. 15A to 15C detail the locking pin used in the present invention.
Figure 15B:
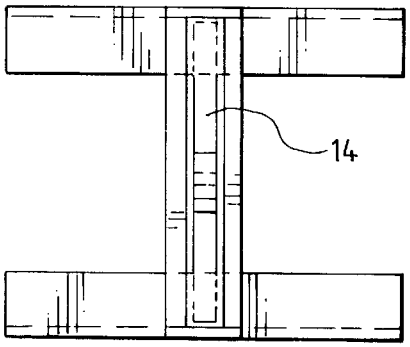
Figure 15C:
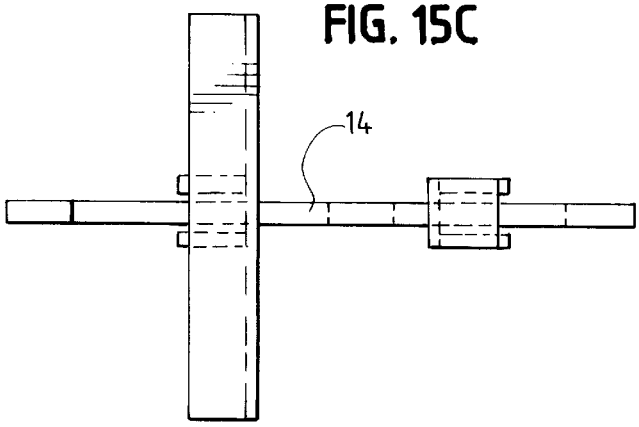

In FIG. 15 is shown, in FIGS. 15A, 15B and 15C, elevational, end and top views of a tapered locking pin 14 and its support ends, which may be used for joining opposed formwork panels in the present invention.

It will be appreciated that by constructing the building in this step-by-step configuration, utilising standardised components, significant advantages over the prior art are achieved. Not only is appropriate alignment and levelling of the walls much easier than by prior art processes, such as described in Australian Patent No. 647783, but the formwork may be re-used on alternative building sites, consequently reducing costs and material wastage. It will be appreciated that the base formwork can be formed out of steel, sheet metal, or rigid plastics material, whereby the system components are removable and re-usable.

The building constructed in accordance with the method of the invention has various advantages compared to former known concrete construction methods with timber, plaster, and other methods. Such advantages include the fact that they are cheaper to heat and cool, and are ideally suited to solar passive designs, they have higher noise insulative properties, and a higher fire resistance, resistance to earthquake, wind loads, weather and termites. Notably however, they provide a less expensive form of construction, and items such as door hinges may be insert moulded in position.

It will be appreciated that variations and modifications to the building method and apparatus as hereinbefore described will become apparent to persons skilled in the art. All such variations and modifications should however be considered to fall within the scope of the invention as broadly hereinbefore described and as claimed hereinafter.

What is claimed is:

1. A method of forming a concrete structure using pourable concrete material, comprising the steps of:

(a) positioning and securing a removable base portion formwork on top of a foundation, the base portion formwork being comprised of a pair of solid opposing base panels defining base portion surfaces of the concrete structure to be formed;

(b) positioning a removable upper portion formwork on top of the base portion formwork, the upper portion formwork being comprised of at least one pair of substantially parallel solid opposing upper panels defining the upper portion surfaces of the concrete structure;

(c) removably securing the upper portion formwork and the base portion formwork together with detachable spacing and securing means located outside the base and upper panels;

(d) pouring concrete material between the solid panels of the upper formwork and the base portion formwork; and (e) detaching the spacing and securing means and removing the base portion and upper portion formwork.

2. A method of forming a concrete structure as claimed in claim 1, wherein the concrete structure is a wall, and wherein the base portion of the wall is constructed first.

3. A method of forming a concrete structure as claimed in claim 1, wherein prior to pouring the concrete material, opening blanking panels are provided at predetermined positions in the formwork such that the concrete material is moulded into desired shapes and prevented from being poured into the predetermined positions, wherein the opening blanking panels are separately secured to the upper and base panels by clamps.

4. A method of forming a concrete structure as claimed in claim 3, wherein the opening blanking panels are embodied by a pair of blanking members for each side of the opening, wherein, the ends of abutting blanking members are terminate in a correspondingly shaped transverse manner to permit easy assembly and disassembly of the blanking members.

5. A method of forming a concrete structure as claimed in claim 1, wherein the base portion formwork comprises a pair of parallel opposing base support frames, each support frame having a lower end adapted to engage with the foundation, and an upper end adapted to receive the upper portion formwork, the support frames defining an exterior concrete surface.

6. A method of forming a concrete structure as claimed in claim 5, wherein the support frames further comprise a pressure release means provided in the upper ends of the support frames.

7. A method of forming a concrete structure as claimed in claim 5, wherein opposed base support frames are retained in position by locking pins, the pins preferably being tapered for ease of removal thereof after the concrete material is set.

8. A method of forming a concrete structure as claimed in claim 1, wherein the parallel opposing upper panels are retained in position by being secured together on top of the base portion formwork by at least one removable support bracket outside the base portion formwork.

9. A method of forming a concrete structure as claimed in claim 1, wherein the parallel opposing upper panels are retained in position by a removable wall spacing support bracket located outside the top of the upper portion formwork.

10. A method of forming a concrete structure as claimed in claim 1, further comprising the step of insulating the formwork.

11. A method of forming a concrete structure as claimed in claim 5, wherein the foundation is comprised of foundation piers and the lower end of each base support frame engages a blanking panel.

12. A method of forming a concrete structure as claimed in claim 1, further comprising the step of:

providing formwork for at least one beam into which concrete material can be poured in-situ on top of the upper portion formwork.

13. A method of forming a concrete structure as claimed in claim 3, further comprising the step of insert molding door hinge supports and striker plates into the concrete material.

* * * * *